US005654694A

United States Patent [19]

Newham

[11] Patent Number: 5,654,694

[45] Date of Patent: *Aug. 5, 1997

[54] MOBILE BATTERY POWERED PATIENT BED AND CHAIR OCCUPANCY MONITORING SYSTEM

[75] Inventor: Paul F. Newham, San Antonio, Tex.

[73] Assignee: Bed-Check Corporation, Tulsa, Okla.

[ * ] Notice: The term of this patent shall not extend beyond the expiration date of Pat. No. 5,640,145.

[21] Appl. No.: 311,418

[22] Filed: Sep. 23, 1994

[51] Int. Cl.[6] ..... G08B 23/00

[52] U.S. Cl. ..... 340/573; 200/85 R; 340/523; 340/529; 340/666

[58] Field of Search ..... 340/573, 667, 340/666, 529, 523, 693; 200/85 R, 85 A

[56] References Cited

U.S. PATENT DOCUMENTS

| | | | |
|---|---|---|---|
| 4,484,043 | 11/1984 | Musick et al. | 200/85 R |
| 4,565,910 | 1/1986 | Musick et al. | 200/85 R |
| 4,633,237 | 12/1986 | Tucknott et al. | 340/573 |
| 5,235,319 | 8/1993 | Hill et al. | 340/573 |
| 5,276,432 | 1/1994 | Travis | 340/573 |
| 5,410,297 | 4/1995 | Joseph et al. | 340/573 |

FOREIGN PATENT DOCUMENTS

| | | | |
|---|---|---|---|
| 9010281 | 9/1990 | WIPO | 340/573 |

*Primary Examiner*—Thomas Mullen
*Attorney, Agent, or Firm*—Frank J. Catalano; Scott R. Zingerman

[57] ABSTRACT

A system for monitoring a long term care device having a sensor thereon for detecting the presence of a patient on the device includes a microprocessor responsive to a resident program. A first circuit connected to the microprocessor and to the sensor automatically activates operation of the microprocessor to a "monitor" mode upon detection by the sensor of the patient's presence on the device, maintains operation of the microprocessor for a predetermined time period at least equal to a running time of the program and terminates operation of the microprocessor at the expiration of the predetermined time period after detection by the sensor of termination of the patient's presence on the device prior to expiration of the predetermined time period. A second circuit operates the system in response to commands manually applied to the second circuit to deactivate the system to a "hold/reset" mode after activating of the system to the "monitor" mode. The first circuit will also activate the system to the "monitor" mode after the system has been deactivated to the "hold/reset" mode together with subsequent detection by the sensor of termination of the patient's presence on the device and resumption of the patient's presence on the device. Alternatively, the microprocessor is responsive to the manually operable switch in the second circuit to activate the system to the "monitor" mode after the system has been deactivated to the "hold/reset" mode. A third circuit connected to the microprocessor provides an audio alarm upon demand by the microprocessor.

18 Claims, 5 Drawing Sheets

MOBILE BATTERY POWERED PATIENT BED AND CHAIR OCCUPANCY MONITORING SYSTEM

BACKGROUND OF THE INVENTION

This invention relates generally to systems for monitoring the presence or absence of a patient in or from a bed, wheelchair or the like and more particularly concerns monitoring systems having programmable capability to tailor the system functions to meet the needs of specific mobile monitoring applications.

Presently known monitoring systems, such as those described in earlier U.S. Pat. Nos. 4,484,043 and 4,565,910, have serious limitations of function and operating capability. First of all, they are generally hard-wired and therefore not useful in most mobile applications, especially in long term or home care situations. Since they are intended for use in short term or hospital environment situations, their hard wiring typically provides a delay between switching and activation to permit multiple manipulations of a patient by the staff without triggering an alarm. They require the manual operation of on/off switches to activate the monitoring process. Once activated they must be shut down completely to enable a nurse to move a patient and then manually operated to reactivate the device after return of the patient. But, once activated, patients can, intentionally or inadvertently, trigger the alarm by removing their weight from the system sensor device and then cancel the alarm by returning their weight to the system sensor device. This frequently results in tiresome "cry wolf" attempts by patients to get attention and can even result in disregard of a valid emergency situation by the monitoring staff. They are not locally modifiable by the monitoring staff to accommodate the needs of a particular patient and/or environment. They generally offer no selection of tonal variations in their audio alarm, no selection of time delay increments in their activate and/or alarm modes and no choices as to the operational steps required to disarm and re-arm the device. A further problem encountered in present monitoring systems is that they employ their on/off switch controls in such a manner that inadvertent disconnection of the sensor device from the system does not cause an alarm. Therefore, the monitoring staff has no assurance that a patient is actually being monitored without repetitive local inspection to assure that the sensor device is properly connected to the system.

It is, therefore, one of the primary objects of this invention to provide a patient monitoring system which is mobile rather than hard-wired. Another primary object of this invention is to provide a patient monitoring system which is suited to long term and/or home care of patients. Still another object of this invention is to provide a patient monitoring system which is programmable on-site by monitoring personnel to adapt the system to each specific patient and environment. It is also an object of this invention to provide a patient monitoring system which is activated by initial pressure on a sensor device rather than by the use of on/off switches. A further object of this invention is to provide a patient monitoring system which can be temporarily deactivated to a "hold" mode by use of a reset control on the unit and which will be automatically reactivated to a "monitor" mode when the patient is returned to the system. Yet another object of this invention is to provide a patient monitoring system in which disconnection of the sensor device from the system will result in a failsafe alarm. And it is an object of the present invention to provide a patient monitoring system which, in its programmable functions, includes variations of type and volume of alarm tones, variation in time delay characteristics and an election to cancel an alarm either by return to the monitored condition by the patient or by an independent disarming activity.

SUMMARY OF THE INVENTION

In accordance with the invention, a system is provided for monitoring a long term care device having a sensor thereon for detecting the presence of a patient on the device. A microprocessor is responsive to a resident program. A first circuit connected to the microprocessor and to the sensor automatically activates operation of the microprocessor to a "monitor" mode upon detection by the sensor of the patient's presence on the device, maintains operation of the microprocessor for a predetermined time period at least equal to a running time of the program and terminates operation of the microprocessor at the expiration of the predetermined time period after detection by the sensor of termination of the patient's presence on the device prior to expiration of the predetermined time period. A second circuit operates the system in response to commands manually applied to the second circuit. The microprocessor is responsive to a manually operable switch in the second circuit to deactivate the system to a "hold/reset" mode after activating of the system to the "monitor" mode. The microprocessor is further responsive to the first circuit to activate the system to the "monitor" mode after the system has been deactivated to the "hold/reset" mode together with subsequent detection by the sensor of termination of the patient's presence on the device and resumption of the patient's presence on the device. Alternatively, the microprocessor is responsive to the manually operable switch in the second circuit to activate the system to the "monitor" mode after the system has been deactivated to the "hold/reset" mode. A third circuit connected to the microprocessor provides an audio alarm upon demand by the microprocessor. The microprocessor is responsive to the first circuit to switch the system from the "monitor" mode to an "alarm" mode and trigger the third circuit to generate an alarm after the system has been activated to the "monitor" mode together with subsequent detection by the sensor of termination of the patient's presence on the device. The microprocessor is responsive to its program to delay switching to the "alarm" mode and generating of the alarm for a predetermined time after detection by the sensor of termination of the patient's presence on the device. The program affords a plurality of alternatives for the predetermined delay time and a fourth circuit having a plurality of switches connected to the microprocessor permits manual programming of the microprocessor to select the predetermined time from the plurality of alternatives. The microprocessor is also responsive to the first circuit to switch the system from the "alarm" mode to the "monitor" mode and disarm the third circuit to cease the alarm after the sensor detects resumption of the patient's presence on the device. Alternatively, the microprocessor is responsive to the switch of the second circuit to switch the system from the "alarm" mode to the "monitor" mode and disarm the third circuit to cease the alarm after manual operation of the switching. The fourth circuit connected to the microprocessor has a plurality of switches connected to the microprocessor for manually programming the microprocessor to select between the first circuit and second circuit for disarming the alarm. The third circuit may have a plurality of components switchably connectable between the microprocessor and an alarm device for, alone and in combination with others, providing different input signals to the alarm device. The fourth circuit would then include a plurality of switches connected to the microprocessor for manually programming the microprocessor to connect corresponding ones of the input signal providing components to the alarm device. A fifth circuit connected to the microprocessor may provide a visual indication upon demand by the microprocessor. The microprocessor will be responsive to the first circuit to cause the fifth circuit to provide an intermittent visual indication when the system is in the "monitor" mode and to cause the third circuit to generate a momentary audio alarm when the system is activated to the "monitor" mode.

The microprocessor is also responsive to disconnection of the first circuit from the microprocessor after the system is activated to the "monitor" mode to cause the third circuit to generate an alarm. Disconnection may occur by either the sensor being disconnected from the first circuit or by an insufficient voltage supply from a voltage source in the first circuit to operate the system.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
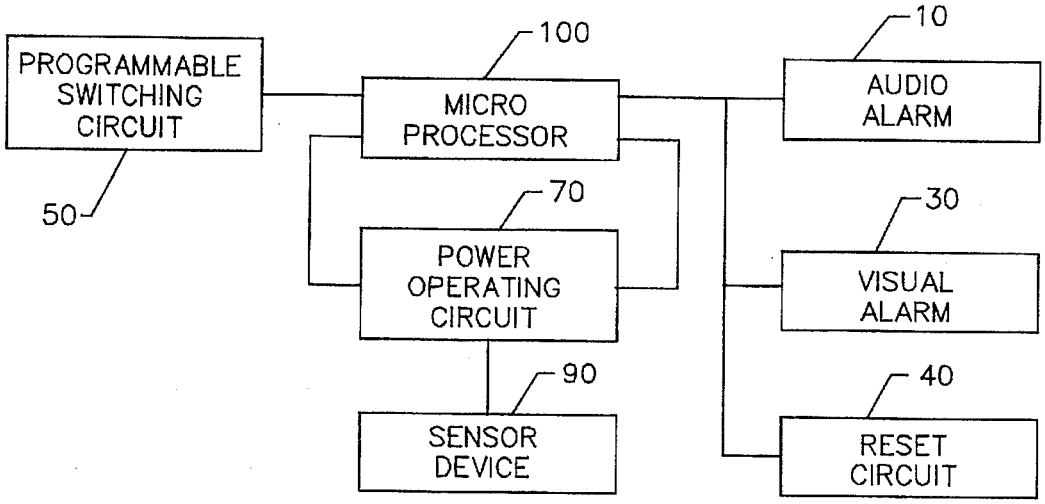
FIG. 1 is a block diagram of a preferred embodiment of the patient monitoring system.

Turning first to FIG. 1, the patient monitoring system includes an audio alarm system 10, a visual alarm system 30, a reset circuit 40, a programmable switching circuit 50, a power operating circuit 70, a sensor device 90 and a microprocessor 100 connected in configuration and for operation as hereinafter explained.

Figure 2:
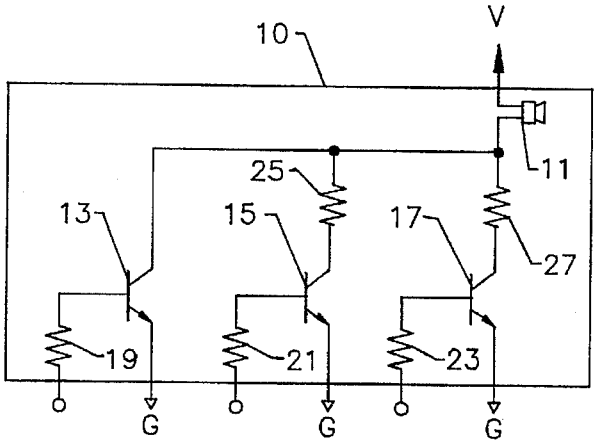
FIG. 2 is a schematic diagram of a preferred embodiment of an audio alarm circuit of the patient monitoring system.

The audio alarm system 10 is shown in detail in FIG. 2 and includes an audio alarm 11 connected between a voltage source V and ground G. Three transistors 13, 15 and 17 have their bases connected through three resistors 19, 21 and 23 to output terminals on the microprocessor 100. The emitter of each of the transistors 13, 15 and 17 is connected to ground G. The collector of the first transistor 13 is connected directly to the audio alarm 11 to provide the highest level audio alarm. The collector of the second transistor 15 is connected through a resistor 25 to the audio alarm 11 to provide an intermediate level audio alarm. The collector of the third transistor 17 is connected through another resistor 27 having resistance greater than the resistance of the second transistor resistor 25 to the audio alarm 11 to provide the lowest level of audio alarm. Thus, the audio alarm level is selectable under the control of the microprocessor 100.

Figure 3:
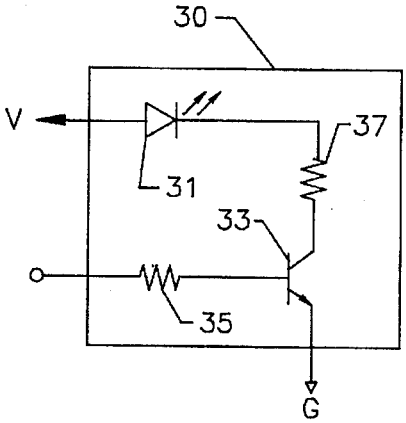
FIG. 3 is a schematic diagram of a preferred embodiment of the visual alarm circuit of the patient monitoring system.

Turning to FIG. 3, the visual alarm system 30 of the patient monitoring system includes an LED 31 connected between the voltage source V and ground G. A transistor 33 has its base connected through a resistor 35 to a terminal of the microprocessor 100. The emitter of the transistor 33 is connected to ground G and the collector of the transistor 33 is connected through another resistor 37 to the LED 31. Thus, the operation of the visual alarm 30 is controlled by the microprocessor 100.

Figure 4:
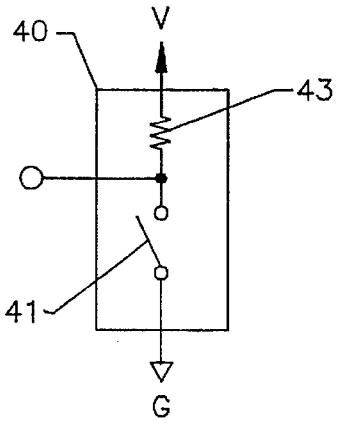
FIG. 4 is a schematic diagram of a preferred embodiment of the reset circuit of the patient monitoring system.

Looking now at FIG. 4, the reset circuit 40 of the patient monitoring system includes a reset switch 41 connected at one side to ground G and at its other side to a terminal of the microprocessor 100 and through a resistor 43 to the voltage source V. Thus, the microprocessor 100 is responsive to operation of the reset circuit 40.

Figure 5:
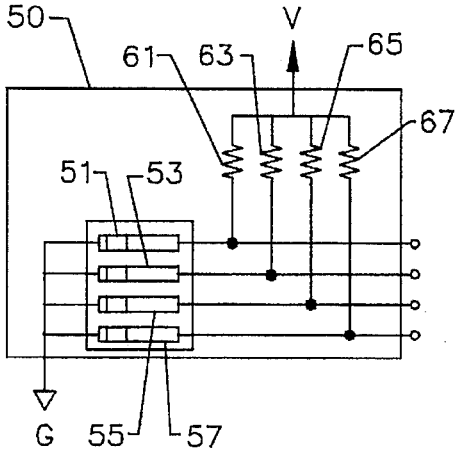
FIG. 5 is a schematic diagram of a preferred embodiment of the programmable switching circuit of the patient monitoring system.

Turning now to FIG. 5, the programmable switching circuit 80 of the patient monitoring system is seen to include four two position switches 51, 53, 55 and 57, each connected on one side to ground G and on the other side each separately connected to the voltage source V through a resistor 61, 63, 65 and 67, respectively, and to a terminal of the microprocessor 100. Thus, monitoring personnel can vary the functional operation of the system by reprogramming the microprocessor 100 via the programmable switching circuit 50. In one preferred embodiment of the patient monitoring system, the first switch 51 permits selection of a one or three second time delay between arming of the system and alarm indication, the second switch 53 permits selection between first and second audio levels, the third switch 55 permits a choice of re-arming by either twice operating the reset button or alternatively re-arming by removal and replacement of pressure on the mat 90 and the fourth switch 57 permits election of a stepped or normal alarm response.

Figure 6:
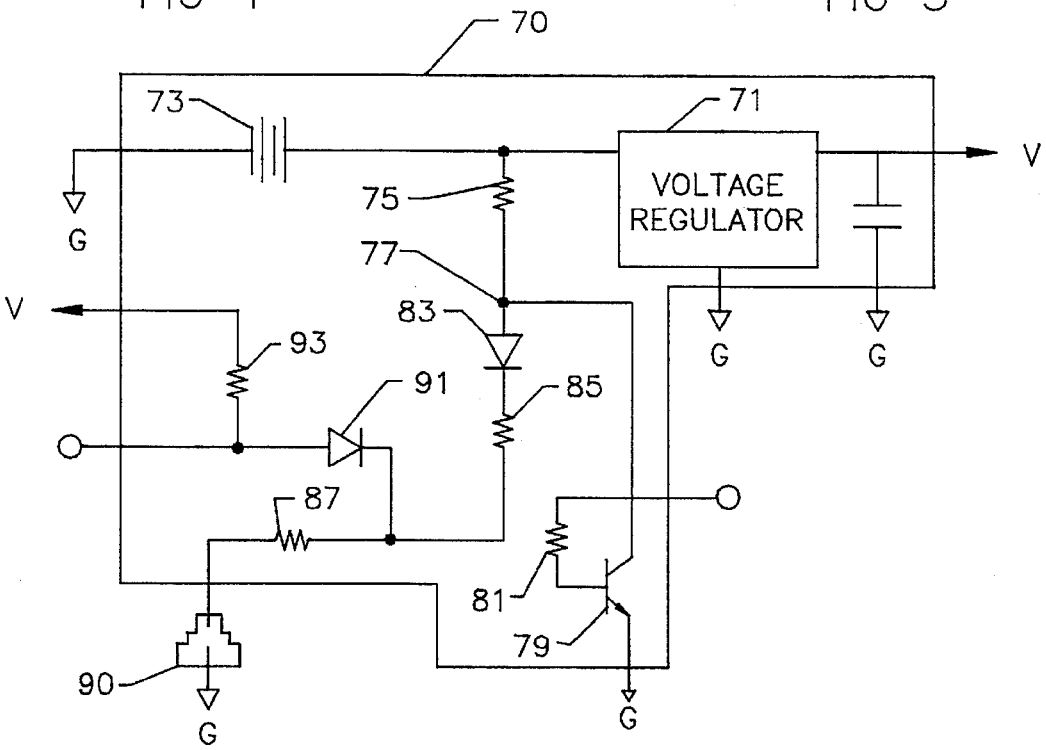
FIG. 6 if a schematic diagram of the preferred embodiment of the power switching circuit of the patient monitoring system.

The power operating circuit 70 of the patient monitoring system is illustrated in FIG. 6 and includes a voltage regulator 71 connected between a power source such as the battery 73 on the input side and the regulated voltage output terminal V (voltage source) to be connected to the other system components. Typically, the battery 73 will be 9 volts and the regulated voltage V will be 5 volts. The control voltage to the voltage regulator 71 is applied from the battery 73 through a resistor 75 to the voltage regulator control terminal 77. A transistor 79 has its collector connected to the control terminal 77 and its emitter connected to ground G. The base of the transistor 79 is connected through a resistor 81 to a terminal of the microprocessor 100. The control terminal 77 is also connected through a blocking diode 83 and resistors 85 and 87 to the sensor mat 90 and thence to ground G. A second blocking diode 91 is also connected between another terminal of the microprocessor 100 and a point between the resistors 85 and 87 in the path to the sensor mat 90, this microprocessor terminal being connected to the voltage source V through a resistor 93. If the mat 90 is plugged into the patient monitoring system without any pressure being applied to the mat 90, no power is delivered to the microprocessor 100. Upon application of pressure to the mat 90, the first blocking diode 83 is grounded, causing the voltage applied at the voltage regulator control terminal 77 to go low, thus energizing the voltage regulator 71 and causing power to be applied to the microprocessor 100. The microprocessor 100 then immediately causes the power operating circuit transistor 79 to be turned on for a predetermined time interval, perhaps 30 to 40 seconds, to maintain power to the microprocessor 100 as it proceeds through its program, even if the initiating pressure is removed from the mat 90. In addition, the presence of pressure on the mat 90 grounds the second blocking diode 91 and causes its associated terminal on the microprocessor 100 to go low, thus indicating to the microprocessor 100 that pressure has been applied to the mat 90. If the pressure on the mat 90 is released before the predetermined time delay, perhaps of 30 to 40 seconds, the power operating circuit transistor 79 will be turned off at the end of the delay period, thus shutting off the microprocessor 100 until the mat 90 again has pressure applied to it. It should also be noted that the first blocking diode 83 prevents the mat pressure detection terminal of the microprocessor 100 from going low under the influence of the power operating circuit transistor 79, thus assuring that the full power of the battery 73 will not be applied to the microprocessor 100.

Figure 7:
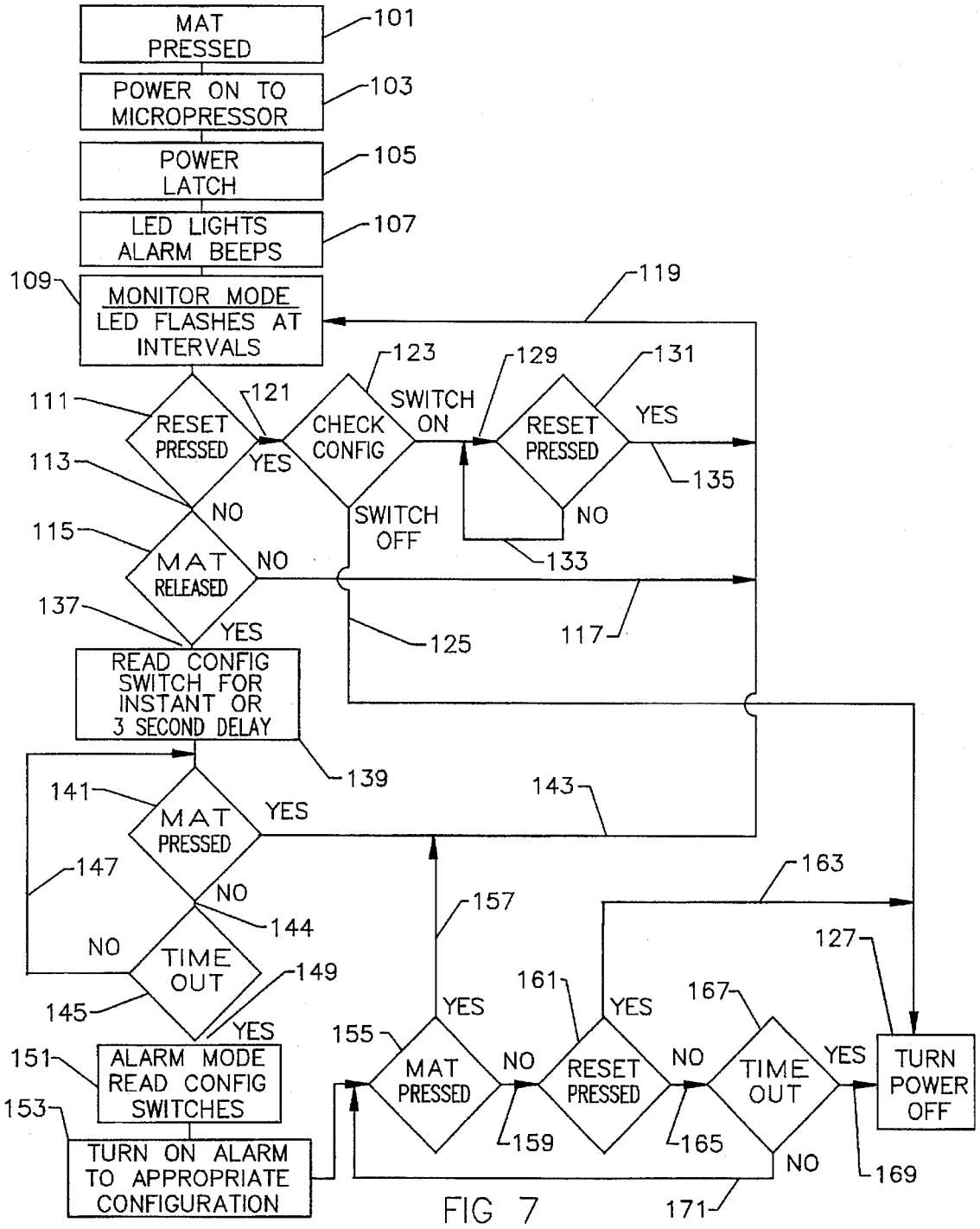
FIG. 7 is a flow chart of a preferred embodiment of the operation of the digital monitoring system under the control of the microprocessor and its associated software.
Figure 9:
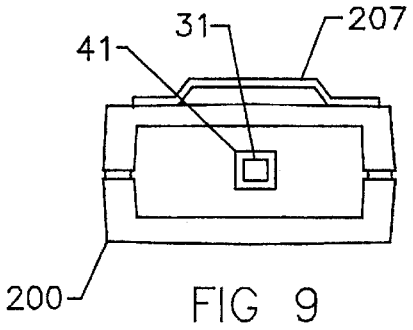
FIG. 9 is a top plan view of the enclosure of FIG. 8.
Figure 8:
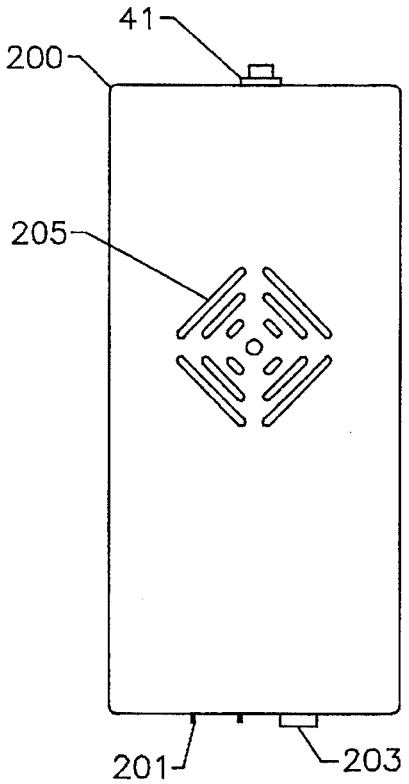
FIG. 8 is a front elevation view of a preferred embodiment of the enclosure of the patient monitoring system.
Figure 10:
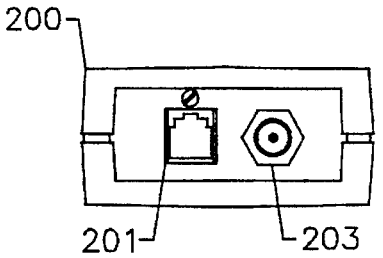
FIG. 10 is a bottom plan view of the enclosure of FIG. 8.
Figure 11:
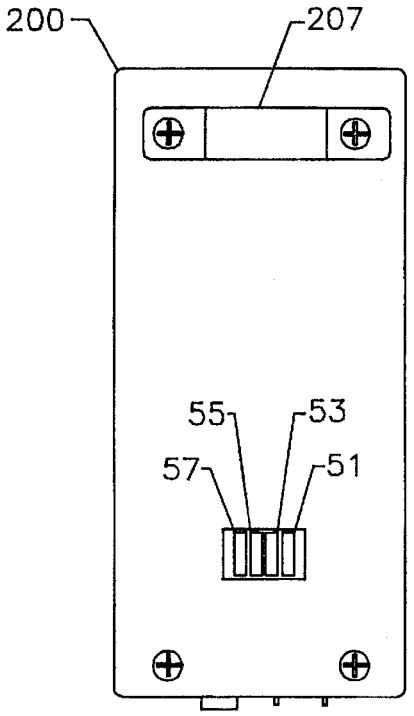
FIG. 11 is a rear elevational view of the enclosure of FIG. 8.
Figure 12:
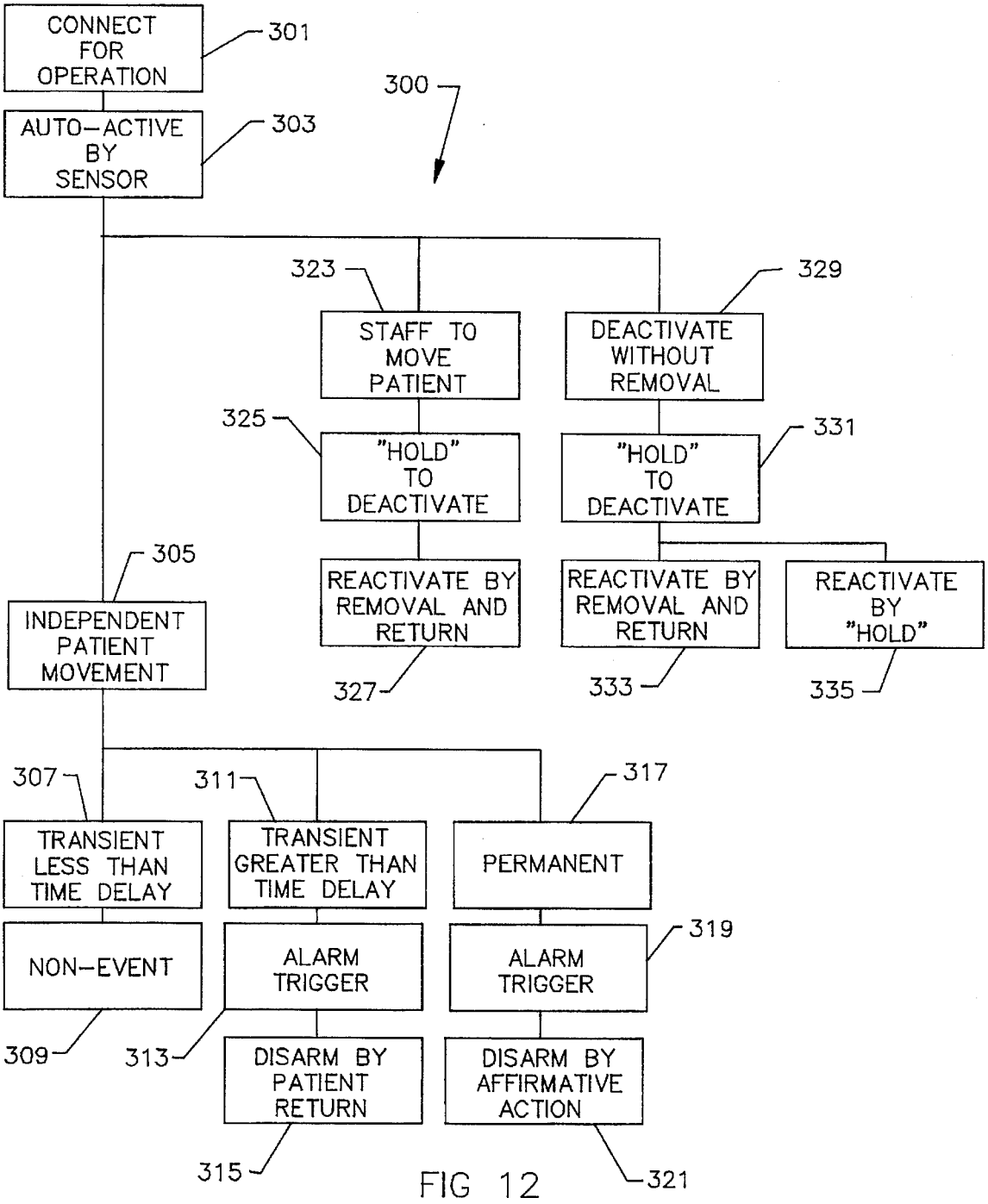
FIG. 12 is a flow chart illustrating the operation of the system from the viewpoint of the monitoring staff.
Figure 4:
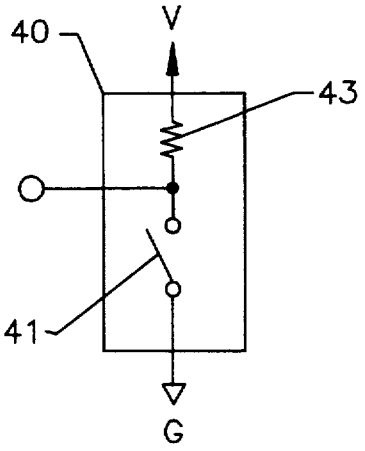
Figure 5:
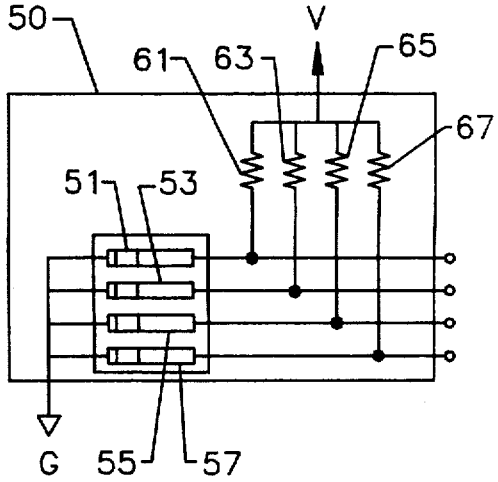
Figure 6:
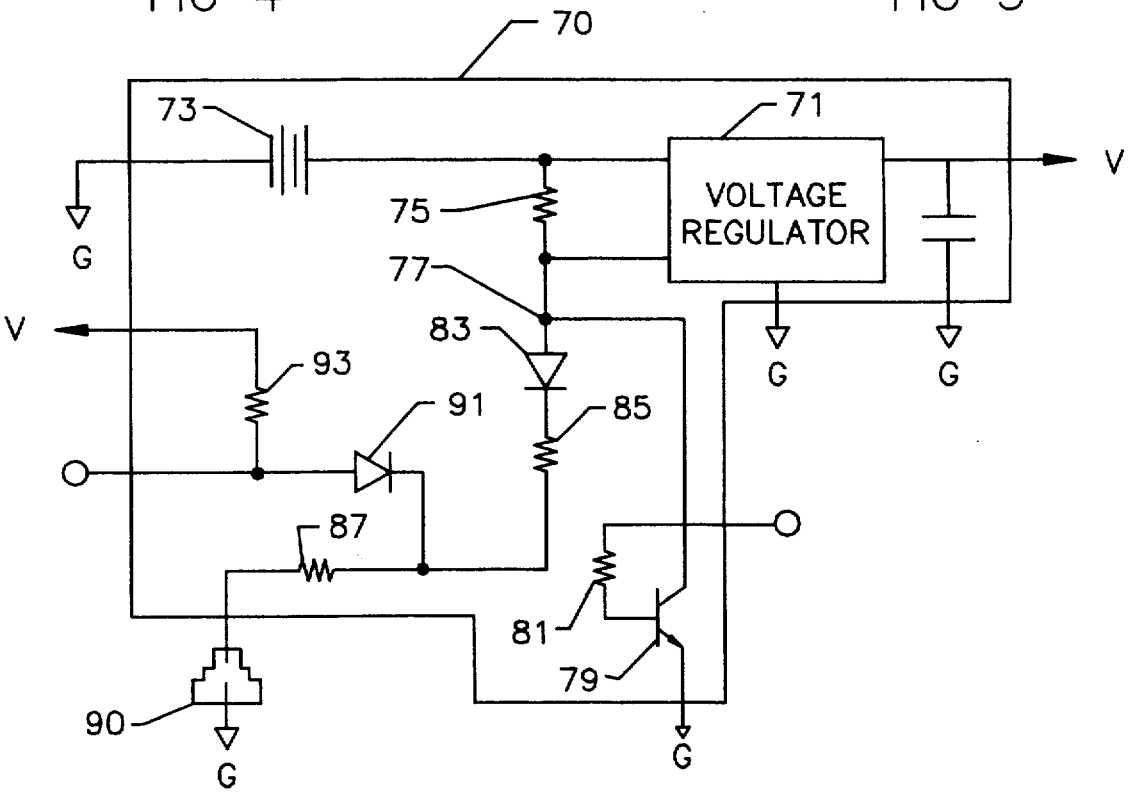

Turning now to FIG. 7, a preferred function arrangement of the patient monitoring system under the control of the internal software of the microprocessor 100 is illustrated. With the system fully connected and before any pressure is applied to the mat 90, no power is available at the microprocessor 100. When the mat 90 is pressed 101, power to the microprocessor 100 is turned on 103 and latched on 105 for the predetermined delay period by the power operating circuit transistor 79. The LED 31 lights momentarily preferably to a bright level, and the audio alarm 11 sounds once 107 to indicate that the patient monitoring system is armed. The system then proceeds to a monitor mode 109 in which the LED 31 flashes at intervals, preferably at a dimmer level than initially occurred, to indicate continued operation of the system. In this condition, the system proceeds to a monitoring loop and inquires as to whether the reset switch 41 has been pressed 111. If the response is NO 113, inquiry is made as to whether the mat 90 has been released 115. If the response to this inquiry is NO 117, the monitoring loop repeats itself many times per second 119. If, however, the response to the reset pressed inquiry 111 is YES 121, then a check configuration step 123 occurs to determine the program status of the programmable switch 55 to choose re-arming by twice operating the reset switch 41. If the programmable switch 55 is in the off condition 125, power to the microprocessor will be turned off 127. If the response to the check configuration step 123 is that the programmable switch 55 is ON 129, the system will further inquire as to whether the reset switch 41 has been pressed a second time 131. If the answer to this inquiry is NO 133, then the reset pressed inquiry 131 will be repeated until such time as the response is YES 135, at which time the monitoring loop will be repeated 119 as before. If the response to the first reset pressed inquiry 111 was NO 113 and the response to the mat released inquiry 115 was YES 137, then the system determines whether the first programmable switch 51 has been programmed for one or three second delay 139 and inquires as to whether the mat 90 remains in the pressed condition 141. If the response to this inquiry is YES 143, then the system returns to the monitoring loop 119. If the answer to the mat pressed inquiry 141 is NO 144, then the system inquires at a time-out step 145 as to whether the interval during which the mat 90 has not been pressed satisfies the interval determined in the time determining step 139. If the answer to the time-out inquiry 145 is NO 147, then the routine returns to the mat pressed inquiry 141 where it is repeated until either the mat is pressed again and the routine continues through the mat pressed path 143 or the time established for the time-out step 145 is achieved and the response to the time-out inquiry 145 is YES 149. If a YES response 149 is received, then the system is in the alarm mode and reads the second and fourth programmable switches 53 and 57 to determine the level and type of audio response to be given 151. The system then turns on the alarm to the appropriate configuration 153. At this point, the system again inquires as to whether the mat 90 is pressed 155. If the answer to this inquiry is YES 157, then the system returns to the monitor loop 119. If the answer to this inquiry is NO 159, then the system will again inquire as to whether the reset switch 41 has been pressed 161. If the answer to the reset pressed inquiry 161 is YES 163, then the system turns power off 127 to the microprocessor 100. If, however, the answer to the reset pressed inquiry 161 is NO 165, then the system inquires at a time-out step 167 as to whether or not a predetermined interval, typically 30 seconds, has occurred in which neither the mat nor the reset has been pressed. If the response to this inquiry is YES 169, then power is turned off 127 to the microprocessor. If the answer to the time-out inquiry 167 is NO 171, then the system returns to the second mat pressed inquiry 155 to continue the alarm signal for the time determined in the second time out step 167.

In normal operation as observed by monitoring personnel, the system is turned off until the mat 90 is pressed. When pressure is applied to the mat 90, the system turns on and a short beep will be heard from the audio alarm 11 while visual indication from the LED 31 will be seen. When pressure is removed from the mat 90, the audio alarm 11 will sound after the selected time delay. Pressing the reset switch 41 will turn off the audio alarm 11. If it is desirable to move the patient without sounding the alarm 11, one press of the reset switch 41 will disarm the system until the reset switch 41 is pressed again or until pressure on the mat 90 is released and reapplied, depending on the position of the programmable switch 55 controlling the re-arming of the system.

Turning to FIGS. 8 through 11 the enclosure 200 containing the entire system is quite small, approximating one inch in depth, 2⅓ inches in width and 4¾ inches in height and preferably has a reset switch 41 containing a red LED 31 on the upper face thereof and a standard four by four phone jack 201 and a recharge jack 203 in the bottom face thereof, the former for connection to the sensor mat 90 and the latter for connection to a recharging power source (not shown). The front of the unit is provided with apertures 205 for alignment with the audio alarm 11 while the back of the unit has the externally accessible programmable switches 51, 53, 55 and 57 thereon. A mounting stop 207 may also be attached to the rear face of the enclosure 200.

Looking at the operation of the system 300 from the viewpoint of the monitoring staff, after the switches 51, 53, 55 and 57 have been manipulated to provide the desired programmable features, the monitoring staff can connect the system for operation 301 by attaching it to the physical device to be monitored, such as a wheelchair, and inserting the sensor 90 into the jack 201. This will result in the hereinbefore discussed visual and audio indicia to confirm that the system is in operating condition. If the battery 73 is not sufficiently charged or if, during the monitoring phase of the system operation, the sensor 90 becomes disconnected from the system, an alarm will be triggered to indicate the malfunction. The system is automatically activated 303 when the patient takes a position in the monitored device which operates the sensor 90. Activation will occur immediately upon application of pressure or after a predetermined time delay of brief duration which may be built into the system. With the system so activated, if the patient moves independently 305, three possibilities result. If the patient's movement is transient and for a time less than the built in alarm time delay 307, the patient's movement will appear as a non-event 309 to the system. If the patient's movement is transient but continues for a time greater than the built in time delay 311, then the alarm will be triggered 313 as soon as the built in time delay, if any, has elapsed. This will be indicated to the monitoring staff by both the audio and visual operation of the alarm as hereinbefore described. Upon return of the patient to the system to again operate the sensor 90, the alarm is disarmed 315 and the system remains in its monitoring state. If the movement of the patient is permanent 317, the alarm will be triggered 319 immediately upon lapse of the built in delay time, if any, and will continue until it is disarmed by the affirmative action 321 of the monitoring staff to press the "hold" or "reset" button 41 to return the system to its initial condition prior to operation of the sensor 90 by the patient.

Returning to the condition 303 in which the system has been activated by the presence of the patient on the monitored device to operate the sensor 90, if the staff desires to move the patient without triggering an alarm 323, it is necessary only to depress the "hold" button 325 to deactivate the system which will then be automatically reactivated after removal from and return to the system of the patient 327. If the staff desires to deactivate the system without moving the patient 329, the staff need only press the "hold" button 41 to deactivate the system 331. In this condition, the system can be reactivated either by the subsequent removal and return of the patient to the monitored device 333 or, in the alternative, by depressing the "hold" button 41 once again 335, provided this option has been included by the setting of the programmable switch 55 assigned for this purpose.

It should be noted that the above system is especially suited to patient long term or home care application. The system is not hard wired so it is mobile with the device supporting the patient. The alarm is automatically immediately triggered unless a time delay is built into the system and is discussed automatically by return of the patient to the system. This encourages or "persuades" the patient to use the mobile support device that the caregiver desires the patient to use. On the other hand, it eliminates the "cry wolf" alarms that can be generated by a patient's rapid transient movement in the device and unnecessarily inconvenience the caregiver. On the other hand, the system gives the caregiver a great deal of flexibility in the control of the system when on-site manipulation of the patient is desirable.

Many modifications can be made to the circuits hereinbefore illustrated in conjunction with a preferred embodiment of the system. Greater numbers of programmable switches can be employed to provide greater flexibility in the functional choices available to the monitoring personnel. Internally determined time delays can be established as may be best suitable for the particular application of the system. Many variations are possible with respect to the duration, volume, brightness and type of audio/visual alarm presented.

Thus, it is apparent that there has been provided, in accordance with the invention, a patient monitoring system that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A system for monitoring a long term care device having a sensor thereon for detecting the presence of a patient on the device comprising:

a microprocessor responsive to a program resident therein; and first circuit means connected to said microprocessor and to the sensor for automatically activating operation of said microprocessor to a "monitor" mode upon detection by the sensor of the patient's presence on the device, for maintaining operation of said microprocessor for a predetermined time period at least equal to a running time of said program and for terminating operation of said microprocessor at the expiration of said predetermined time period if detection by said sensor of termination of the patient's presence on the device occurs prior to expiration of said predetermined time period.

2. A system according to claim 1 further comprising second circuit means for activating and deactivating said system in response to commands manually applied to said second circuit means.

3. A system according to claim 2, said microprocessor further being responsive to a manually operable switching means in said second circuit means for deactivating said system to a "hold/reset" mode after activating of said system to said "monitor" mode.

4. A system according to claim 3, said microprocessor further being responsive to said first circuit means to activate said system to said "monitor" mode after said system has been deactivated to said "hold/reset" mode and subsequent detection by the sensor of termination of the patient's presence on the device and resumption of the patient's presence on the device.

5. A system according to claim 3, said microprocessor further being responsive to said manually operable switching means in said second circuit means to activate said system to said "monitor" mode after said system has been deactivated to said "hold/reset" mode.

6. A system according to claim 5 further comprising third circuit means connected to said microprocessor for providing an audio alarm upon demand by said microprocessor.

7. A system according to claim 6, said microprocessor being responsive to said first circuit means to switch said system from said "monitor" mode to an "alarm" mode and trigger said third circuit means to generate an alarm after said system has been activated to said "monitor" mode and subsequent detection by the sensor of termination of the patient's presence on the device.

8. A system according to claim 7, said microprocessor further being responsive to said program to delay switching to said "alarm" mode and generating of said alarm for a predetermined time after detection by the sensor of termination of the patient's presence on the device.

9. A system according to claim 8, said program having a plurality of alternatives of said predetermined time and said system further comprising fourth circuit means having a plurality of switches connected to said microprocessor for manually programming said microprocessor, said microprocessor being responsive to said manual programming of said fourth circuit means to select said predetermined time from said plurality of alternatives.

10. A system according to claim 8, said microprocessor further being responsive to said first circuit means to switch said system from said "alarm" mode to said "monitor" mode and disarm said third circuit means to cease said alarm after the sensor detects resumption of the patient's presence on the device.

11. A system according to claim 8, said microprocessor further being responsive to said switching means of said second circuit means to disarm said third circuit means to cease said alarm after manual operation of said switching means.

12. A system according to claim 8, said microprocessor further being responsive to said first circuit means to switch said system from said "alarm" mode to said "monitor" mode and disarm said third circuit means to cease said alarm after the sensor detects resumption of the patient's presence on the device and said microprocessor further being responsive to said switching means of said second circuit means to disarm said third circuit means to cease said alarm after manual operation of said switching means, said system further comprising fourth circuit means connected to said microprocessor having a plurality of switches connected to said microprocessor for manually programming said microprocessor, said microprocessor being responsive to said manual programming of said fourth circuit means to select between said first circuit means and said second circuit means for disarming said alarm.

13. A system according to claim 6, said third circuit means having a plurality of means switchably connectable between said microprocessor and an alarm device for providing different input signals to said alarm device and said system further comprising fourth circuit means connected to said microprocessor having a plurality of switches connected to said microprocessor for manually programming said microprocessor, said microprocessor being responsive to said manual programming by said plurality of switches to connect selected ones of said input signal providing means and selected combinations of said input signal providing means to said alarm device.

14. A system according to claim 6 further comprising fifth circuit means connected to said microprocessor for providing a visual indication upon demand by said microprocessor.

15. A system according to claim 14, said microprocessor being responsive to said first circuit means to cause said fifth circuit means to provide an intermittent visual indication when said system is in said "monitor" mode.

16. A system according to claim 15, said microprocessor being responsive to said first circuit means to cause said third circuit means to generate a momentary audio alarm when said system is activated to said "monitor" mode.

17. A system according to claim 6, said microprocessor further being responsive to interruption of operation of said first circuit means after said system is activated to said "monitor" mode to cause said third circuit means to generate an alarm.

18. A system according to claim 17, said interruption of operation of said first circuit means occurring upon any of:

a. the sensor being disconnected from said first circuit means; and b. insufficient voltage supply from a voltage source in said first circuit means to operate said system.

* * * * *

UNITED STATES PATENT AND TRADEMARK OFFICE

CERTIFICATE OF CORRECTION

PATENT NO. : 5,654,694

DATED : August 5, 1997

INVENTOR(S) : Paul F. Newham

It is certified that error appears in the above-identified patent and that said Letters Patent is hereby corrected as shown below:

Column 7, line 50, change "discussed" to -- disconnected--;

In the Drawing:

Delete Drawing Sheet 2, and substitute therefor the Drawing Sheet, consisting of FIGS. 4-6, as shown on the attached page.

Signed and Sealed this

Sixth Day of January, 1998

*Attest:*

*Attesting Officer*

BRUCE LEHMAN

*Commissioner of Patents and Trademarks*

2/5